US008407913B2

(12) United States Patent
Langley et al.

(10) Patent No.: US 8,407,913 B2
(45) Date of Patent: Apr. 2, 2013

(54) CONDITIONER INFUSER FOR HAIR DRYER ATTACHMENT

(75) Inventors: Luther D. Langley, Sterling, IL (US); James E. McCambridge, Polo, IL (US)

(73) Assignee: Wahl Clipper Corporation, Sterling, IL (US)

( * ) Notice: Subject to any disclaimer, the term of this patent is extended or adjusted under 35 U.S.C. 154(b) by 1230 days.

(21) Appl. No.: 11/862,819

(22) Filed: Sep. 27, 2007

(65) Prior Publication Data

US 2009/0083986 A1 Apr. 2, 2009

(51) Int. Cl.
*A45D 20/10* (2006.01)

(52) U.S. Cl. ..... 34/95; 34/97; 606/41; D28/18; 392/384; 132/271

(58) Field of Classification Search ..... 34/94, 95, 34/96, 97; 606/41; 96/222; D28/18; 392/384; 239/555.3; 132/271, 272, 212
See application file for complete search history.

(56) References Cited

U.S. PATENT DOCUMENTS

| | | | | | |
|---|---|---|---|---|---|
| 3,645,009 | A | * | 2/1972 | Ketchum | 34/104 |
| 3,750,657 | A | * | 8/1973 | Lyon | 601/16 |
| 3,888,018 | A | * | 6/1975 | Gaski, Jr. | 34/99 |
| 3,981,313 | A | * | 9/1976 | Burke et al. | 132/118 |
| 3,981,314 | A | * | 9/1976 | Barradas | 132/118 |
| 4,035,927 | A | * | 7/1977 | Spiegel | 34/622 |
| 4,132,360 | A | * | 1/1979 | Lee, Jr. | 239/383 |
| 4,162,580 | A | * | 7/1979 | Hess | 34/103 |
| 4,173,231 | A | * | 11/1979 | Isino et al. | 132/271 |
| 4,198,556 | A | * | 4/1980 | Crowley et al. | 392/384 |
| 4,230,279 | A | * | 10/1980 | Forsberg | 239/559 |
| 4,278,223 | A | * | 7/1981 | Fauteux | 248/125.8 |
| 4,287,673 | A | * | 9/1981 | Wolter | 34/97 |
| 4,295,283 | A | * | 10/1981 | Tomaro | 34/97 |
| 4,308,670 | A | * | 1/1982 | Bonnema | 34/97 |
| 4,361,966 | A | * | 12/1982 | Downey | 34/99 |
| 4,382,174 | A | * | 5/1983 | Barns | 392/410 |
| 4,391,047 | A | * | 7/1983 | Janssens et al. | 34/97 |
| 4,430,808 | A | * | 2/1984 | Toyomi et al. | 34/97 |
| 4,506,454 | A | * | 3/1985 | Kerschgens | 34/275 |
| 4,602,146 | A | * | 7/1986 | Barns et al. | 392/384 |
| 4,615,347 | A | * | 10/1986 | Schooley | 132/212 |
| 4,685,479 | A | * | 8/1987 | McClean | 132/229 |
| 4,704,744 | A | * | 11/1987 | Myers | 2/174 |
| 4,746,090 | A | * | 5/1988 | Hamilton | 248/314 |
| 4,759,135 | A | * | 7/1988 | Scivoletto | 34/97 |
| 4,815,219 | A | * | 3/1989 | Binger | 34/443 |
| 4,827,105 | A | * | 5/1989 | Brown, Jr. | 392/385 |
| 4,835,879 | A | | 6/1989 | Egelstad | |

(Continued)

FOREIGN PATENT DOCUMENTS

| | | | | |
|---|---|---|---|---|
| DE | 3115696 | A1 | * | 10/1982 |
| DE | 3805345 | A1 | * | 8/1989 |

(Continued)

*Primary Examiner* — Stephen M. Gravini
(74) *Attorney, Agent, or Firm* — Greer, Burns & Crain, Ltd.

(57) ABSTRACT

A conditioner infuser cartridge for use with a dryer attachment having an attachment end for engagement with a hair dryer barrel, an opposite air outlet end and a perforated portion between the ends having at least one air intake, the cartridge configured for engagement near the attachment end and including a conditioner element constructed and arranged for retaining a supply of vaporizable conditioner and a support frame receiving the conditioner element and securing same in the attachment.

17 Claims, 8 Drawing Sheets

U.S. PATENT DOCUMENTS

| | | | | | |
|---|---|---|---|---|---|
| 4,848,007 | A | * | 7/1989 | Montagnino | 34/97 |
| 4,896,021 | A | * | 1/1990 | Poweleit et al. | 392/379 |
| 4,936,027 | A | * | 6/1990 | Tsuji | 34/90 |
| 4,955,145 | A | * | 9/1990 | Scivoletto | 132/271 |
| 4,972,065 | A | * | 11/1990 | Ohlsen | 392/380 |
| 4,999,928 | A | * | 3/1991 | Tozier | 34/90 |
| 5,009,730 | A | * | 4/1991 | Tozier | 156/85 |
| 5,036,601 | A | * | 8/1991 | Mulle et al. | 34/97 |
| 5,054,211 | A | * | 10/1991 | Shulman | 34/97 |
| 5,060,398 | A | * | 10/1991 | Wolens | 34/90 |
| 5,161,317 | A | * | 11/1992 | McDougall | 34/97 |
| 5,235,759 | A | * | 8/1993 | Rizzuto, Jr. | 34/97 |
| 5,271,160 | A | * | 12/1993 | Greiner et al. | 34/283 |
| 5,275,339 | A | * | 1/1994 | Andis et al. | 239/443 |
| 5,467,540 | A | * | 11/1995 | Bastien | 34/97 |
| 5,471,763 | A | * | 12/1995 | McArthur | 34/96 |
| 5,488,783 | A | * | 2/1996 | Parkinson et al. | 34/98 |
| 5,572,800 | A | * | 11/1996 | West | 34/97 |
| 5,621,980 | A | * | 4/1997 | Kingsbury | 34/97 |
| 5,628,123 | A | * | 5/1997 | Chan | 34/90 |
| 5,649,370 | A | | 7/1997 | Russo | |
| 5,689,896 | A | * | 11/1997 | Smetana | 34/97 |
| 5,701,681 | A | * | 12/1997 | Wonka et al. | 34/97 |
| 5,729,907 | A | * | 3/1998 | Santhouse et al. | 34/98 |
| 5,746,228 | A | * | 5/1998 | Parker | 132/232 |
| 5,761,824 | A | * | 6/1998 | Moon et al. | 34/97 |
| 5,765,292 | A | * | 6/1998 | Chan | 34/98 |
| 5,956,863 | A | * | 9/1999 | Allen | 34/97 |
| 6,044,574 | A | * | 4/2000 | Haghkhah et al. | 34/90 |
| 6,089,239 | A | * | 7/2000 | Ehlhardt et al. | 132/271 |
| 6,094,837 | A | * | 8/2000 | Cantor | 34/97 |
| 6,775,922 | B2 | | 8/2004 | Langley et al. | |
| 6,895,975 | B2 | * | 5/2005 | Hafemann | 132/228 |
| 6,922,909 | B2 | * | 8/2005 | Andrew et al. | 34/96 |
| 7,047,660 | B2 | * | 5/2006 | Leventhal | 34/97 |
| 7,412,781 | B2 | * | 8/2008 | Mattinger et al. | 34/96 |
| 2003/0145871 | A1 | * | 8/2003 | Hafemann | 132/234 |
| 2004/0047620 | A1 | * | 3/2004 | Ruben | 392/385 |
| 2004/0088878 | A1 | * | 5/2004 | Langley et al. | 34/96 |
| 2004/0163274 | A1 | * | 8/2004 | Andrew et al. | 34/98 |
| 2005/0108889 | A1 | * | 5/2005 | Leventhal | 34/96 |
| 2005/0229422 | A1 | * | 10/2005 | Mattinger et al. | 34/96 |
| 2006/0248744 | A1 | | 11/2006 | Langley | |
| 2007/0137060 | A1 | * | 6/2007 | Woodson | 34/97 |
| 2009/0019719 | A1 | * | 1/2009 | Yde et al. | 34/96 |
| 2009/0083986 | A1 | * | 4/2009 | Langley et al. | 34/98 |
| 2009/0100698 | A1 | * | 4/2009 | Primm | 34/97 |
| 2009/0188125 | A1 | * | 7/2009 | Fung | 34/68 |
| 2010/0012141 | A1 | * | 1/2010 | Middlebrook | 132/202 |
| 2010/0012344 | A1 | * | 1/2010 | Dannenberg et al. | 174/53 |
| 2010/0014844 | A1 | * | 1/2010 | Dannenberg et al. | 392/381 |
| 2010/0263223 | A1 | * | 10/2010 | Wynne | 34/97 |
| 2011/0010958 | A1 | * | 1/2011 | Clark et al. | 34/97 |

FOREIGN PATENT DOCUMENTS

| | | | | |
|---|---|---|---|---|
| DE | 4109775 | A1 | * | 10/1991 |
| DE | 4039759 | A1 | * | 6/1992 |
| DE | 4227845 | A1 | * | 3/1993 |
| DE | 4445237 | C1 | * | 5/1996 |
| EP | 439781 | A1 | * | 8/1991 |
| EP | 473822 | A1 | * | 3/1992 |
| EP | 503210 | A1 | * | 9/1992 |
| EP | 543558 | A1 | * | 5/1993 |
| EP | 622032 | A1 | * | 11/1994 |
| EP | 631738 | A1 | * | 1/1995 |
| EP | 940101 | A2 | * | 9/1999 |
| EP | 1 518 475 | | | 3/2005 |
| FR | 2694874 | A1 | * | 2/1994 |
| GB | 2211732 | A | * | 7/1989 |
| GB | 2255906 | A | * | 11/1992 |
| GB | 2259007 | A | * | 3/1993 |
| GB | 2263401 | A | * | 7/1993 |
| GB | 2270838 | A | * | 3/1994 |
| GB | 2 315 019 | | | 1/1998 |
| JP | 52084055 | A | * | 7/1977 |
| JP | 05146311 | A | * | 6/1993 |
| WO | WO 9637125 | A1 | * | 11/1996 |
| WO | WO 9709899 | A1 | * | 3/1997 |

* cited by examiner

CONDITIONER INFUSER FOR HAIR DRYER ATTACHMENT

BACKGROUND OF THE INVENTION

The present invention relates generally to powered hair styling devices, and more particularly to attachments for such devices used for assisting the cutting or styling process.

Hair styling devices include powered clippers and trimmers, as well as hair dryers, straighteners, curling irons, hot air brushes, curlers and the like. As is well known in the art, each such device is used for a particular part of the hair styling process. In many cases, attachments are provided for hair styling devices. In the case of hair clippers and trimmers, attachment combs are provided for maintaining the length of cut hair. In the case of hair dryers, attachments are employed for more evenly distributing heat without damaging the hair or scalp.

Concentrators, diffusers, and finger pics are types of hair dryer attachments added to the output end of a hair dryer. Finger pics, or attachments for hair dryers with finger like projections, have been used for many years. A finger pic allows the user to pick up their hair during the drying process to speed up drying as well as to add body by fluffing the hair. A plurality of hair dryer attachments is disclosed in commonly-assigned U.S. Pat. No. 6,775,922 which is incorporated by reference.

Hair dryers used daily create heated airflow that removes vitality from a user's hair. Due to this heat and the typical associated brushing and combing used in the drying process, hair becomes brittle, loses its natural oils and shine, has split ends, and suffers from many other negative, hair-degrading qualities. A user typically relies upon separate liquid or gel hair additives, including but not limited to moisturizers, vitamins, silicones, oils, herbs, minerals, proteins, fragrances, panthenol, quaternaries, color and the like, collectively referred to here as conditioners, that are used upon drying completion or during the drying process. Conditioners are commonly accepted as providing a way for maintaining hair natural and shiny, protecting against other chemicals and holding type products, and for making hair healthier.

This need to repair hair damage done by hair dryers, as well as enhancement to one's hair beauty, has resulted in a multi-billion dollar hair supplement business. During the styling process, the user typically applies a dose of conditioner to the hands, rubs the hands together, and then runs the hands through the hair prior to or after drying. The user then needs to wash and dry the hands prior to further drying or other styling. This required procedure adds significant time to the styling process.

The addition of moisture or fragrance to the airflow of a hair dryer has been known for years as well. Moisture has been added to dryers via mechanical means and fragrance has been added via quite a few different methods. A typical conventional hair dryer attachment employing a conditioner additive is disclosed in U.S. Pat. No. 5,649,370 to Russo in which the outlet of the attachment is provided with a supply of material producing a scented vapor. However, the attachment outlet is partially blocked, impairing the flow of vapor with the dryer air flow. Another drawback of the configuration in Russo is that the axial separation of the attachment from the end of the dryer barrel causes excessive premature dilution of the vapor. While suitable for the intended deodorizing objectives as described in Russo, this arrangement has been found to be unsuitable for use in applying hair conditioners.

Thus, there is a need for an improved hair styling attachment that more efficiently uses hair conditioners. There is also a need for an improved hair styling attachment enabling the user to obtain a more uniform distribution of conditioner applied to the hair. Still another need is for a hair styling device which reduces the time required in the hair styling process.

BRIEF SUMMARY OF THE INVENTION

The above-listed needs are met or exceeded by the present hair styling attachment and associated conditioner applicator, which more completely integrates the hair conditioner into the hair styling process. With the present attachment, the hair conditioner is easily added to the hair before drying is completed, thus reducing damage to hair by the drying process. In addition, the present hair styling attachment reduces the time required for hair styling.

More specifically, a conditioner infuser cartridge is provided for use with a dryer attachment having an attachment end for engagement with a hair dryer barrel, an opposite air outlet end and a perforated portion between the ends having at least one air intake, the cartridge configured for engagement near the attachment end and including a conditioner element constructed and arranged for retaining a supply of vaporizable conditioner and a support frame configured for receiving the conditioner element and securing same in the attachment.

In another embodiment, a combination hair dryer attachment and conditioner infuser cartridge includes a dryer attachment having an attachment end for engagement with a hair dryer barrel, an opposite air outlet end. A conditioner infuser cartridge is configured for engagement near the attachment end and includes a conditioner element made of foam and having a cylindrical, hollow shape, and a support frame receiving the conditioner element and securing same in the attachment, the support frame having an annular seat and a tubular cage portion.

DETAILED DESCRIPTION OF THE INVENTION

Figure 1:
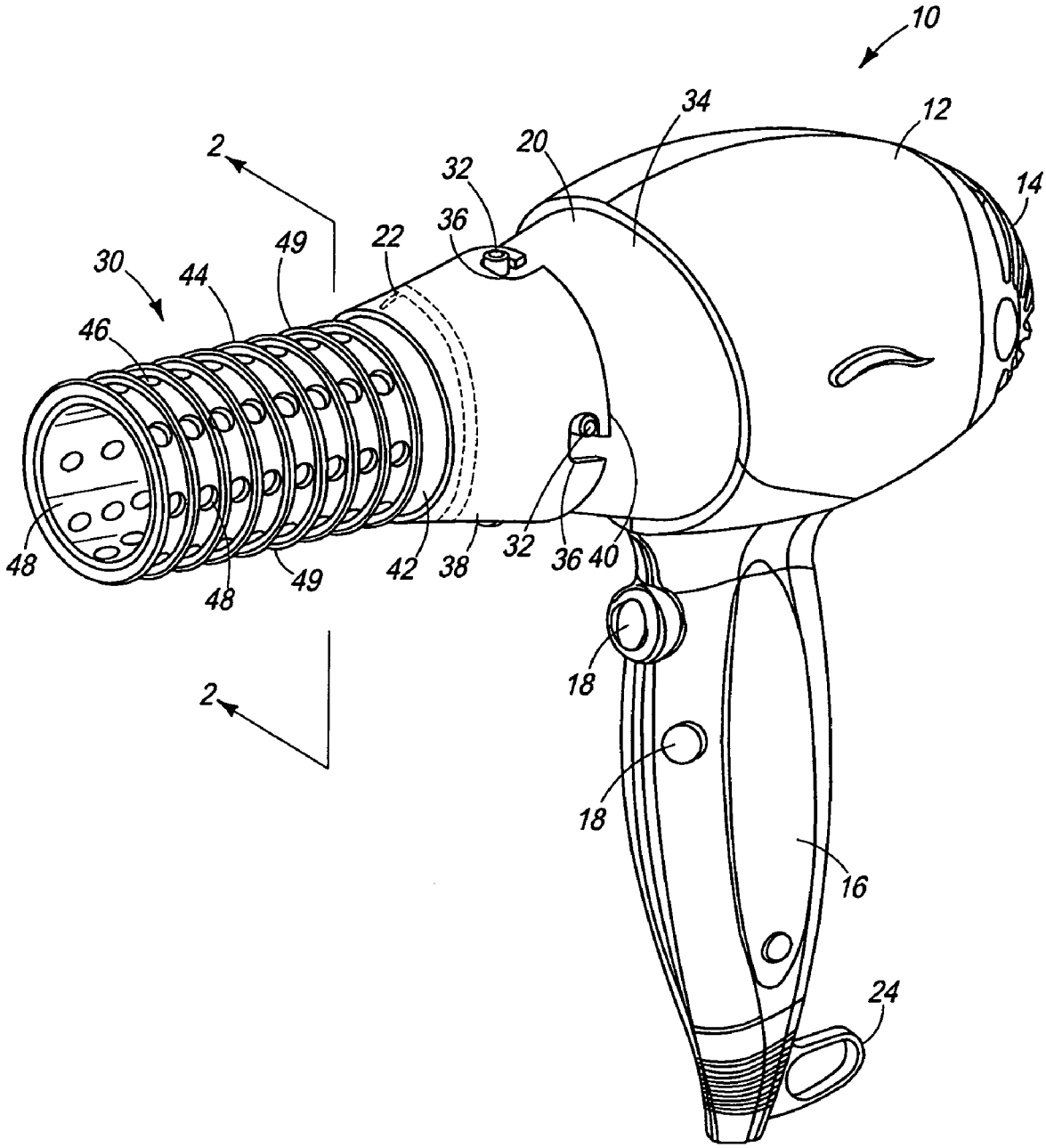
FIG. 1 is a top perspective view of a hair dryer provided with the present conditioner infuser attachment system.
Figure 2:
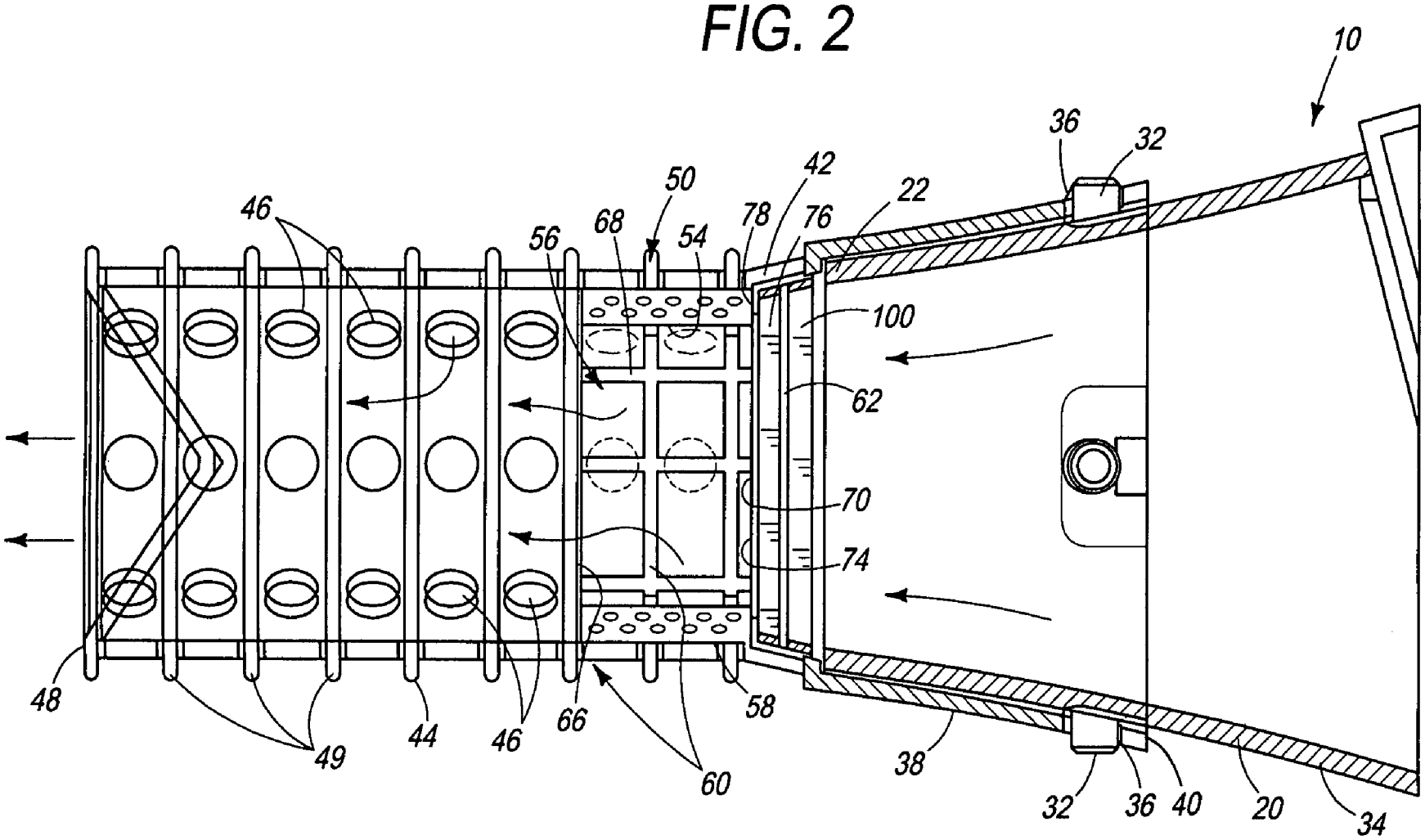
FIG. 2 is a vertical section taken along the line 2-2 of FIG. 1 and in the direction indicated.
Figure 3:
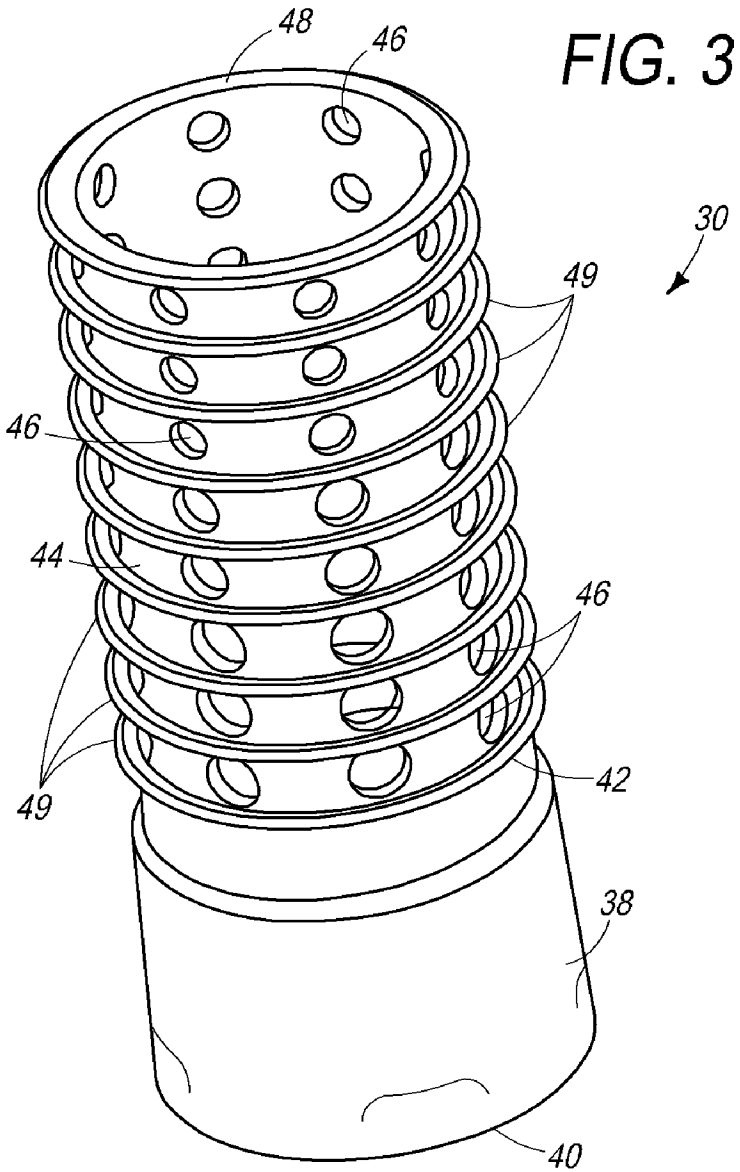
FIG. 3 is a top perspective view of the attachment of FIG. 2.
Figure 4:
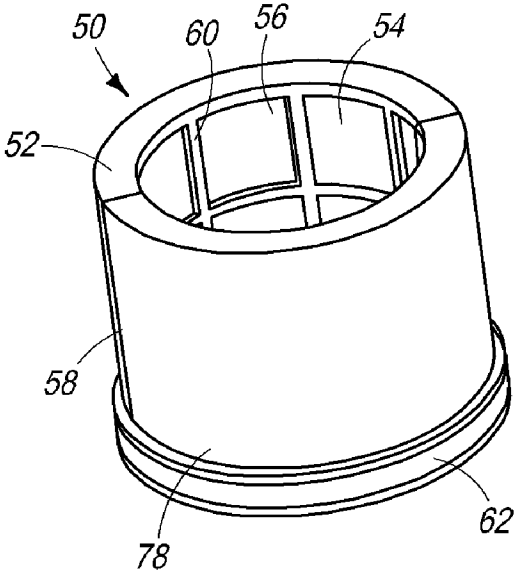
FIG. 4 is a top perspective view of the present infuser cartridge.

Referring now to FIGS. 1-3, a hand held hair dryer suitable for use with the present system is generally designated 10, and includes a housing 12 with an air intake 14, a handle 16, at least one switch 18 for controlling heat and/or fan speed as is known in the art, and a barrel 20 having an outlet 22 (shown hidden). It is contemplated that the number and disposition of the switches 18 may vary to suit the application as is known in the art. Also, the barrel 20 is contemplated as preferably being generally cylindrical, cylindrical or ovate when viewed head on, and/or slightly tapered as is common in the art. Barrel shape and/or length may vary to suit the application. If desired, a hanging loop 24 may be provided for suspending the dryer 10 when not in use. Also, it is to be understood that the dryer 10 is provided with a fan, fan motor, heating element, wiring and other internal components typically found in such products, and may optionally be equipped with an ionizing feature for reduction of static electricity in the hair. It is also to be understood that while the present preferred hair styling device is a dryer, other hot air-producing hair styling devices are contemplated, which are collectively referred to here as hair dryers.

As is known in the art, the dryer 10 is optionally provided with at least one attachment 30 for directing, diffusing and/or concentrating air flow from the dryer outlet as desired by the user. While an aeration barrel-type attachment 30 is depicted, it is contemplated that the present conditioner infuser can be incorporated in a variety of known styles of dryer attachments.

Figure 7:
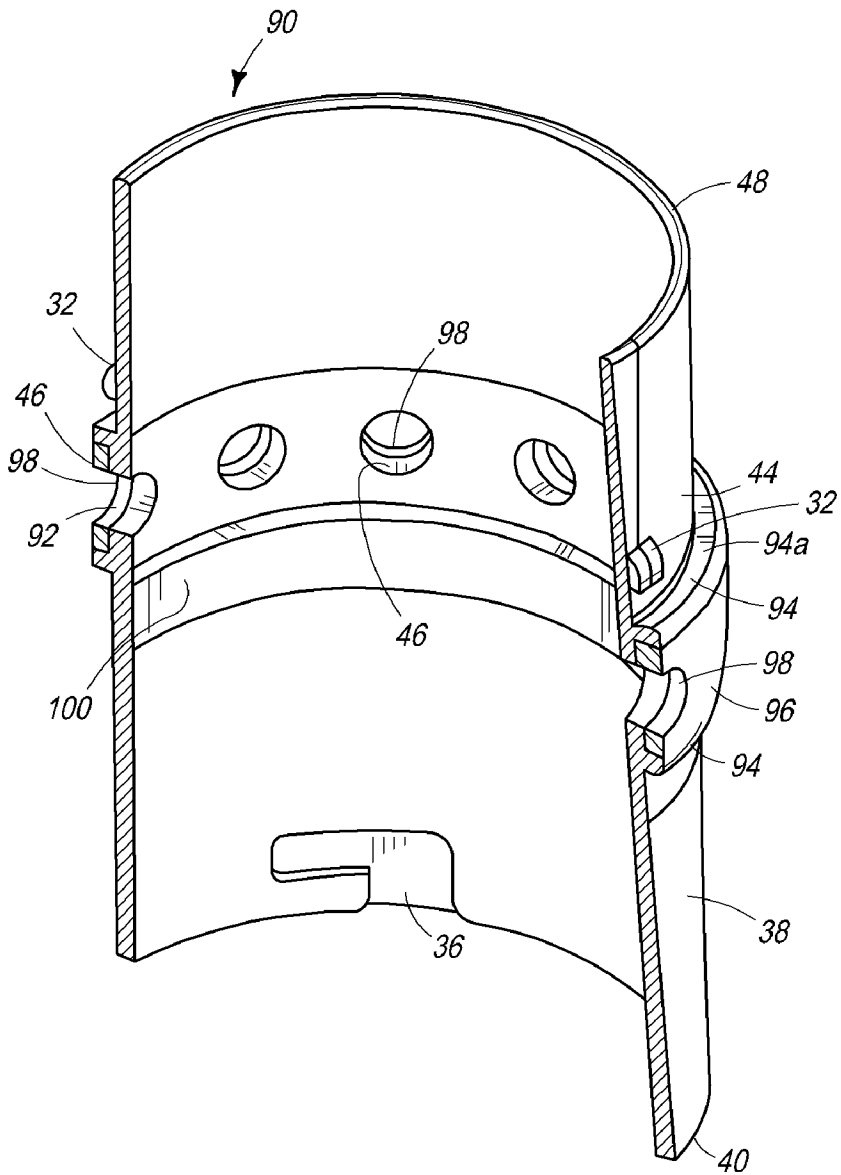
FIG. 7 is a fragmentary perspective view of another alternate embodiment of the present attachment with an adjustment ring shown in an open position.
Figure 9:
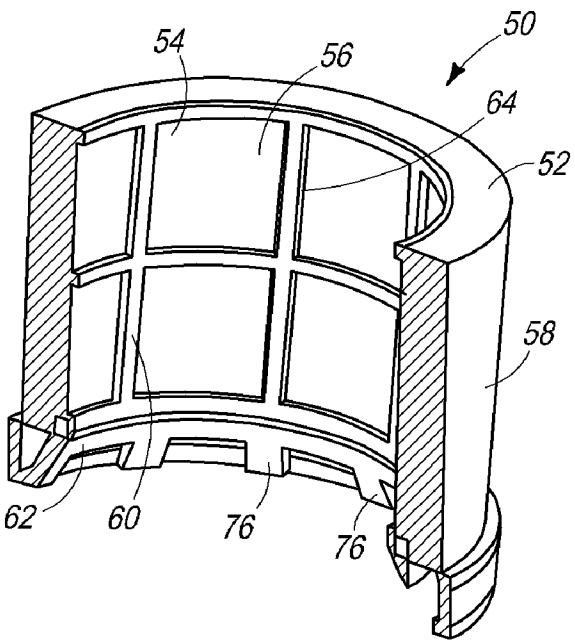
FIG. 9 is a fragmentary perspective view of the cartridge of FIG. 4.

The attachment 30 is interchangeably attachable to the barrel 20, using a friction fit or a mechanical engagement depicted in FIG. 1 and disclosed in more detail in U.S. Pat. No. 6,775,922 which is incorporated by reference. As is known in the art, the attachment 30 is preferably made of lightweight, structurally strong and temperature resistant materials, such as high temperature polypropylene or the like. A releasable locking arrangement is achieved which positively locates the attachment 30 on the barrel 20 to provide adequate support and to prevent unwanted disengagement of the attachment from the dryer 10. At least one and preferably a plurality of radially extending boss or lug formations 32 are peripherally spaced on an exterior surface 34 on the barrel 20. The number and positioning of the formations 32 corresponds to a number of "J"-shaped bayonet-type notches or recesses 36 disposed on an apron 38 of the attachment. The recesses 36 may be exposed (FIG. 1) or shrouded (FIG. 7). Thus, a bayonet-lug attachment arrangement is provided, as is known in the mechanical arts.

In the preferred embodiment, there are four lug formations 32 positioned at approximate 90° increments around the barrel 20 and aligned on a common plane, however the number and spacing of the formations 32, 36 may vary to suit the application. This spacing of the formations 32, 36 permits the attachments 30 to be oriented at different positions on the barrel 20 as desired by the user.

The apron 38 defines an attachment end 40 of the attachment 30, which is where the attachment engages the dryer barrel 20. Generally flared, the apron 38 has a larger diameter at the attachment end 40 than a second end 42 which is adjacent a working portion 44 of the attachment 30. At least one and preferably a plurality of perforations or air inlet openings 46 are provided in the working portion 44 to allow the inflow of outside or ambient air into the attachment 30. This outside air enhances flow characteristics as the ambient air mixes with air emitted from the dryer barrel 20 and exits an attachment air outlet end 48. It has been found that for best results, the air outlet end 48 is unobstructed. In the preferred embodiment, the perforations 46 are provided in peripherally spaced rows which extend parallel to an axis of the attachment 30. Also preferred on the attachment 30 is a plurality of spaced, radially-projecting annular ribs 49 provided to sidewall, the ribs separating adjacent perforations in the sidewall.

Referring now to FIGS. 2, 4, 5, 9 and 10, a conditioner infuser cartridge, generally designated 50, is configured for engagement near the attachment end 40 and includes a conditioner element 52 made of a resilient, absorbent, chemical and heat resistant material such as open cell foam. A variety of such materials are contemplated, and are collectively designated here as foam. In the preferred embodiment, the conditioner element 52 has a cylindrical, hollow shape, with an inner surface 54 defining an air passageway 56. An outer surface 58 of the element 52 is engaged with an interior of the attachment 30 (FIG. 2). The inner surface 54 is supported by a support frame 60 which is preferably cage or skeleton-like in construction to enhance the exposure of the inner surface with air traveling though the air passageway 56. A main function of the support frame 60 is for receiving the conditioner element 52 and securing same in the attachment 30. Included on the support frame 60 are an annular seat 62 and a tubular cage portion 64. The frame 60 is preferably an integral unit produced by injection molding or the like, however separate fabrication and assembly is also contemplated. The seat 62 has a larger diameter than the cage portion 64.

Figure 5:
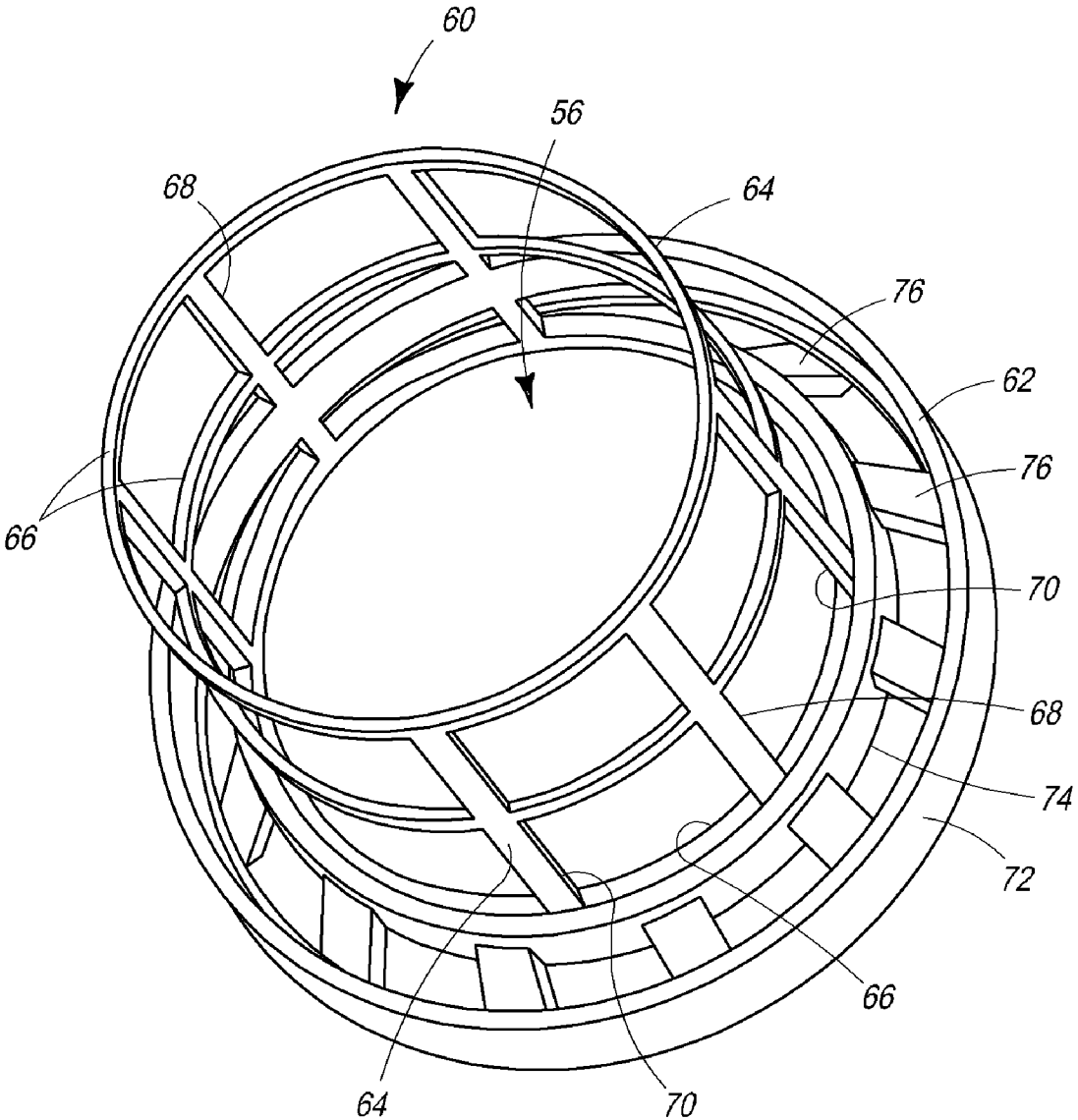
FIG. 5 is a top perspective view of the support frame for the present cartridge.

More specifically, and referring to FIG. 5, the tubular cage portion 64 includes a plurality of axially spaced rings 66 connected together by a plurality of peripherally spaced elongate bars 68 extending parallel to a longitudinal axis of the cartridge 50. A seat end 70 of each bar is connected to the seat 62. Also perforated or apertured for promoting air circulation, the seat 62 has an outer ring 72 secured to an inner ring 74 by a plurality of radially extending, spaced tabs 76. The seat 62 is configured for receiving and supporting an end 78 of the conditioner element 52.

Upon insertion of the tubular cage portion 64 into the air passageway 56 of the conditioner element 52 until the end 78 contacts the seat 62 (FIG. 4), the cartridge 50 is assembled. Next, the cartridge 50 is placed into the attachment 30 and is held therein by a friction fit, detents, ribs or other equivalent releasable fastening technology (FIG. 2). A conditioner is applied to the conditioning element 52, such as by pouring or spraying a liquid or applying a paste or other format such that the conditioner becomes impregnated in the foam. By conditioner is meant vaporizable moisturizers, conditioning compounds, styling oils, styling gels, mousses, Vitamin E, Vitamin C, silicone, fragrance, panthenol, quaternaries, color and hair oils and the like.

Referring now to FIG. 2, the cartridge 50 is disposed relative to the perforations 46 so that outside air passes through the perforations 46 and also through the element 52, and is mixed with air emitted from the dryer 10 prior to flowing through the air outlet end 48. In addition to the creation of a Venturi effect, which enhances the airflow out the outlet end 48, in this manner, the conditioner will be more uniformly vaporized and mixed with the dryer air prior to reaching the target hair. The ambient air also cools the superheated air from the dryer, creating a vapor mist for enhancing uniform conditioner distribution. After at least one application, if the user determines that the conditioner has been depleted, additional doses of conditioner can be applied to the element 52. Alternately, users can change the conditioner depending on the circumstances.

Figure 6:
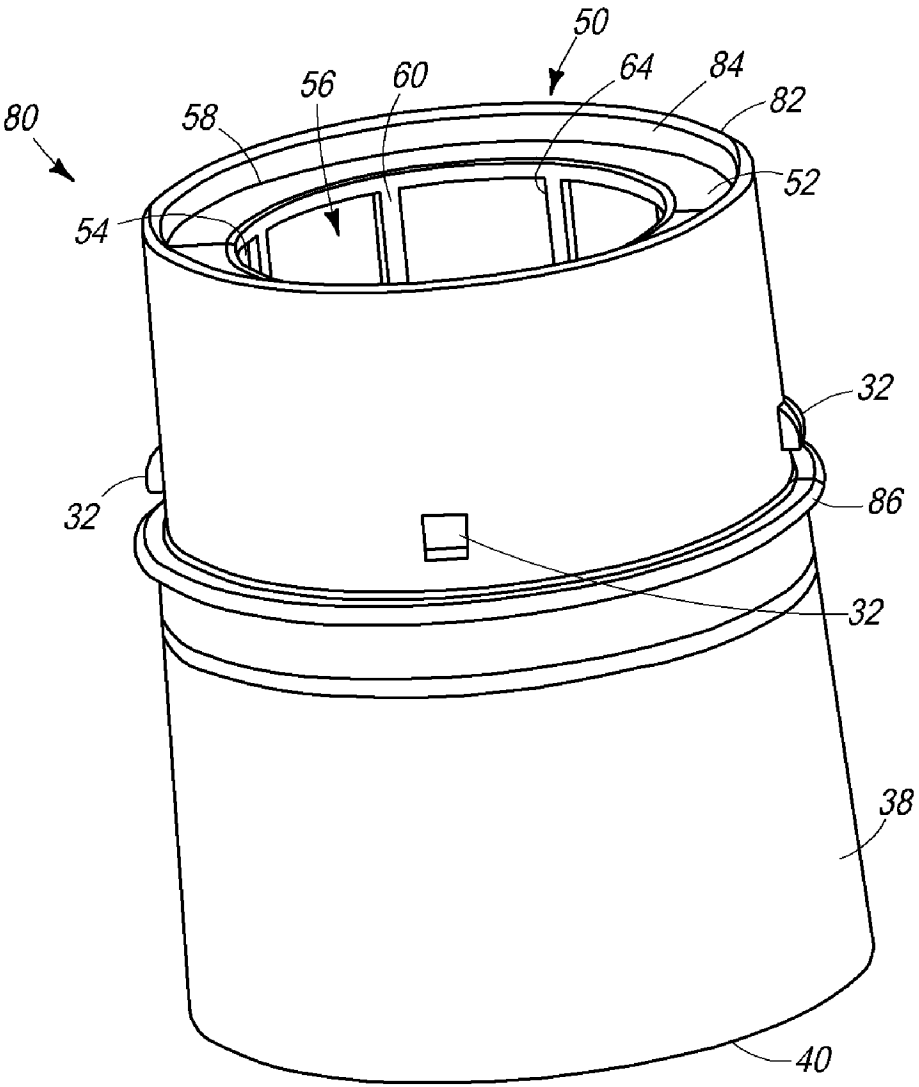
FIG. 6 is a top perspective view of an adapter attachment suitable for use with the present diffuser cartridge.

Referring now to FIG. 6, an alternate embodiment of the present attachment 30 is generally designated 80. Components shared between the attachments are designated with identical reference numbers. A main distinction between the attachments 30 and 80 is that the latter is not perforated and the preferably tubular attachment serves as an adapter between the dryer 10 and alternate, conventional attachments not equipped for accommodating the present conditioner infuser cartridge 50. As is the case with the attachment 30, the attachment has an apron 38 defining an attachment end 40. The apron 38 in the attachment 80 is configured for a friction engagement with the dryer barrel 20.

Opposite the attachment end 40 is an outlet end 82 which is provided with a reduced, preferably tapered diameter for receiving other attachments, either by friction fit, using the bayonet lug system described above, or other attachment systems. In the depicted embodiment, a plurality of the boss formations 32 is provided. An interior wall 84 of the outlet end 82 is dimensioned for accommodating the conditioner infuser cartridge 50 similar to the engagement depicted in FIG. 2. A shoulder 86 defines the different diameters between the apron 38 and the air outlet end 82 and may provide a support for an engaged attachment, depending on the design. A performance distinction between the attachments 30 and 80 is that the latter lacks any perforations, and as such ambient air does not mix with the conditioner prior to flowing through the air outlet end 82. Instead, the air emitted from the dryer barrel 20 triggers the vaporization of the conditioner and carries the conditioner to the hair.

Referring now to FIGS. 7-10, another embodiment of the present attachment is generally designated 90. Components shared with the attachments 30 and 80 are designated with identical reference numbers. A feature of the attachment 90 is that it can accommodate another attachment and serve as an adapter, as is the case with the attachment 80. Another feature of the attachment 90 is that, in addition to accommodating the conditioner infuser cartridge 50 (FIG. 10), it provides the user with the option of regulating the amount of ambient air drawn into the attachment which passes through the conditioner element 52. As such, the amount of vapor emitted by the dryer 10 is adjusted.

More specifically, the attachment 90 includes a single row of perforations 46 between the attachment end 40 and the air outlet end 48. An annular track 92 is defined by a pair of axially spaced, radially projecting rails 94. The rails sandwich the row of perforations 46. An annular perforated collar 96 having a plurality of peripherally spaced apertures 98 is rotatably engaged in the track and is held therein by a tongue-in-groove, detent-in-groove or similar rotatable fastening relationship as is known in the art. The number and spacing of the apertures 98 corresponds to and preferably matches the row of perforations 46 so that upon relative rotation of the collar 96, the flow of ambient air can be controlled.

Figure 8:
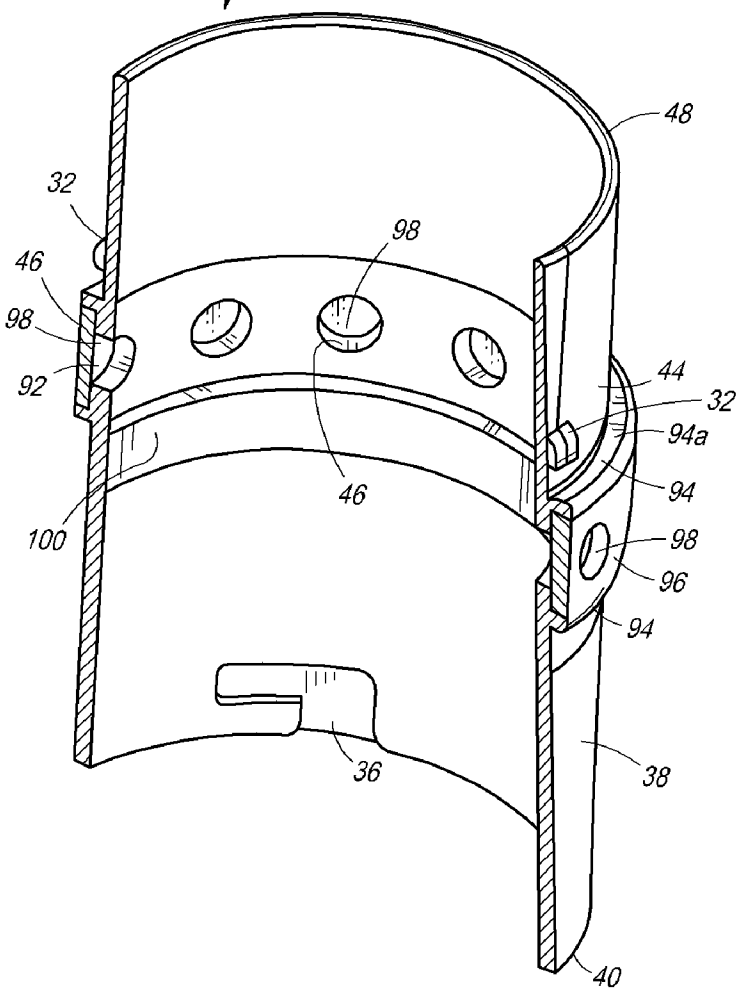
FIG. 8 is a fragmentary perspective view of the attachment of FIG. 7 shown in a closed position.

FIG. 7 depicts the collar in a fully open position, permitting maximum entry of ambient air. Conversely, FIG. 8 depicts a fully closed position of the collar 96, in which no ambient air flow is permitted. To facilitate locating the cartridge 50 in the attachment 90, an internal rib 100 is provided, which may be continuous or a plurality of spaced segments. The rib 100, which is also contemplated in the attachments 30 and 80, is configured for engaging the seat 62 by abutment or by being enveloped by the seat (FIG. 10).

Figure 10:
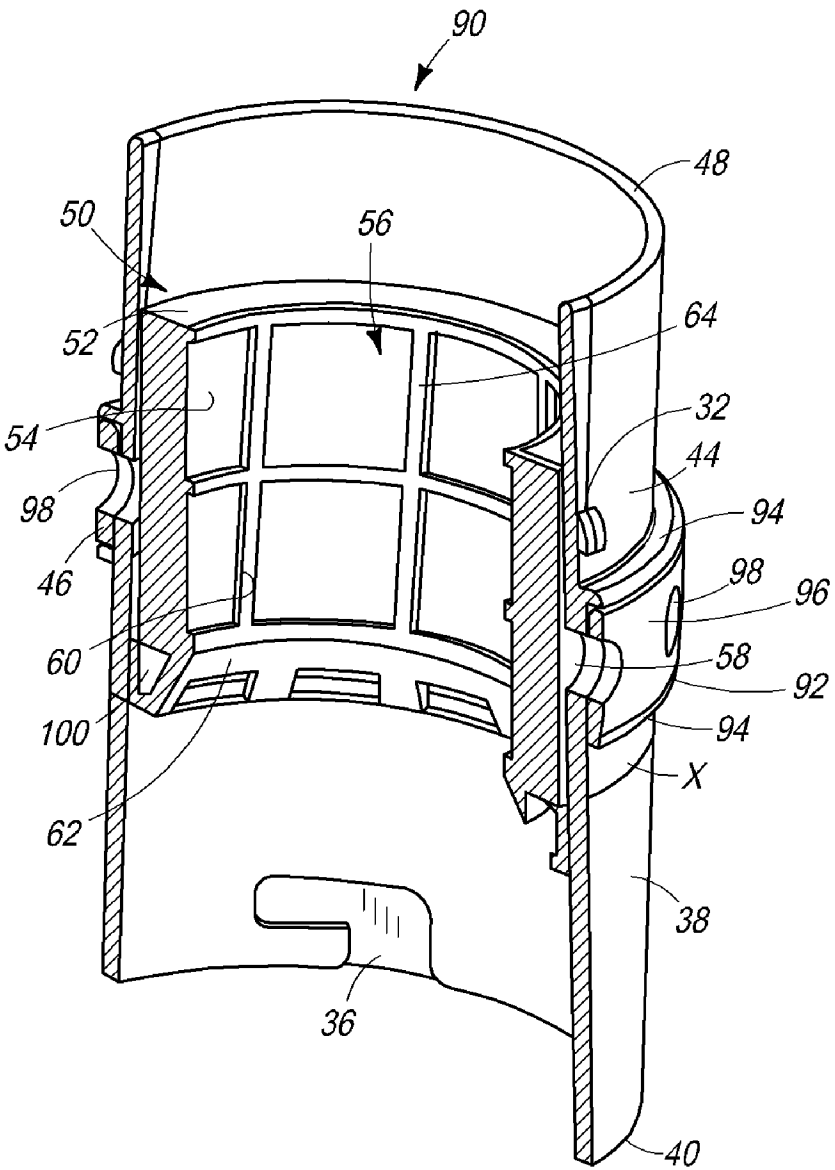
FIG. 10 is a fragmentary perspective view of the assembled cartridge and attachment of FIG. 7.

Referring now to FIGS. 7, 8 and 10, the working portion 44 of the attachment 90 is provided with a tapered shape to receive conventional attachments having aprons 38 similar to that depicted in FIG. 3, either with a friction fit, using notches 36 engaging fastening formations 32 or other known attachment formations. An upper rail 94*a* functions as the shoulder 86 and optionally provides a supportive stop for an end of some attachments. An advantage of the present attachment 90 when used as an adapter is that it not only accommodates the cartridge 50, and thus permits conventional attachments to dispense conditioner, it also allows for regulation of the incoming ambient air flow. The latter feature permits the regulation of the conditioner flow as a function of dryer air flow for all types of attachments.

While specific embodiments of the present conditioner infuser cartridge have been shown and described, it will be appreciated by those skilled in the art that changes and modifications may be made thereto without departing from the invention in its broader aspects and as set forth in the following claims.

What is claimed is:

1. A conditioner infuser cartridge for use with a dryer attachment having an attachment end for engagement with a hair dryer barrel, an opposite air outlet end and a perforated portion between the ends having at least one air intake, said cartridge configured for engagement near the attachment end and comprising:

an absorbent, self-supporting, unitary conditioner element having a hollow shape including a generally cylindrical inner surface of said element defining an air passageway in communication with the air outlet upon assembly on the dryer, said absorbent conditioner element retaining a supply of vaporizable conditioner; and a support frame including an open tubular cage portion including a plurality of axially spaced rings connected with elongate, peripherally spaced bars and engaging said inner surface for securing said conditioner element against an inner wall of the attachment and for further defining the axially projecting, open air passageway.

2. The cartridge of claim 1 wherein said support frame includes an annular seat for engaging an end of said conditioner element.

3. The cartridge of claim 2 wherein said annular seat is apertured and has an outer diameter configured for fastening in said apron adjacent said perforated portion.

4. The cartridge of claim 1 wherein said conditioner element is made of foam, and said support frame has an annular seat, said seat having a larger diameter than said cage portion and is configured for supporting an end of said conditioner element.

5. The attachment of claim 1 wherein said conditioner is provided in a vaporizable state and is activated upon sufficient heat being generated by the dryer.

6. The attachment of claim 5 wherein the conditioner is taken from the group consisting of moisturizers, vitamins, silicones, oils, herbs, minerals, proteins, fragrances, panthenol, quaternaries and hair color.

7. A combination hair dryer attachment and conditioner infuser cartridge, comprising:

a dryer attachment having an attachment end for engagement with a hair dryer barrel, and an opposite, unobstructed air outlet end;

a conditioner infuser cartridge configured for engagement near said attachment end and including a conditioner element made of foam and having a cylindrical, hollow shape defining a longitudinal axis and an axially extending air passageway, and a support frame receiving said conditioner element and securing same in said attachment, said support frame having an annular seat engaging said dryer attachment and an axially extending, open tubular cage portion engaging and supporting an inner surface of said conditioner element along said longitudinal axis and surrounding said passageway such that said passageway located interior of said frame is unobstructed and said inner surface of said conditioner element is exposed to air traveling through said passageway.

8. The combination of claim 7, wherein said dryer attachment has a perforated portion between said ends having a plurality of annularly arranged perforations and an annular collar rotatable relative to said attachment at said perforations so that rotation of said collar relative to said perforations controls the amount of air flow through said perforations.

9. The combination of claim 8, wherein said collar is perforated, having a series of spaced perforations matching said perforations of said attachment exterior.

10. The combination of claim 8, wherein said exterior is provided with an annular track, and said collar is rotatable in said track.

11. The combination of claim 8, wherein said attachment is an adapter and has a working portion configured for accommodating conventional dryer attachments.

12. The combination of claim 7, wherein said seat is perforated.

13. The combination of claim 7 further including a plurality of spaced, radially projecting annular ribs provided to a sidewall of said attachment, said ribs separating adjacent perforations in said sidewall.

14. The combination of claim 7 wherein said attachment is a tubular, imperforated adapter configured for installation onto an end of a dryer barrel and constructed and arranged for releasably engaging said cartridge.

15. The combination of claim 7 wherein said dryer attachment has a perforated portion between said ends having a plurality of annularly arranged perforations, and wherein said attachment is engaged upon the dryer barrel, and said perforations are constructed and arranged so that outside air passes through said element and is mixed with air emitted from the dryer prior to flowing through said air outlet end.

16. The combination of claim 7 wherein said seat has a larger diameter than said cage portion and said tubular cage portion is configured for supporting an inner wall of said conditioner element.

17. A combination hair dryer attachment and conditioner infuser cartridge, comprising:

a dryer attachment having an attachment end for engagement with a hair dryer barrel, an opposite, unobstructed air outlet end;

a conditioner infuser cartridge configured for engagement near said attachment end and including a conditioner element made of foam and having a cylindrical, hollow shape defining an air passageway, and a support frame receiving said conditioner element and securing same in said attachment, said support frame having an annular seat and a tubular cage portion engaging and supporting an inner surface of said conditioner element and surrounding said passageway such that said passageway interior of said frame is unobstructed and said inner surface of said conditioner element is exposed to air traveling through said passageway;

said dryer attachment having a perforated portion between said ends having a plurality of annularly arranged perforations and an annular collar rotatable relative to said attachment at said perforations so that rotation of said collar relative to said perforations controls the amount of air flow through said perforations; and said collar is perforated, having a series of spaced perforations matching said perforations of said attachment exterior.

* * * * *